US008484020B2

(12) United States Patent
Krishnan et al.

(10) Patent No.: US 8,484,020 B2
(45) Date of Patent: Jul. 9, 2013

(54) DETERMINING AN UPPERBAND SIGNAL FROM A NARROWBAND SIGNAL

(75) Inventors: Venkatesh Krishnan, San Diego, CA (US); Daniel J. Sinder, San Diego, CA (US); Ananthapadmanabhan Arasanipalai Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 298 days.

(21) Appl. No.: 12/910,564

(22) Filed: Oct. 22, 2010

(65) Prior Publication Data

US 2011/0099004 A1 Apr. 28, 2011

Related U.S. Application Data

(60) Provisional application No. 61/254,623, filed on Oct. 23, 2009.

(51) Int. Cl.

| | |
|---|---|
| ***G10L 19/00*** | (2006.01) |
| ***G10L 19/14*** | (2006.01) |
| ***G10L 19/12*** | (2006.01) |

(52) U.S. Cl.

USPC ..... 704/219; 704/205; 704/221; 704/501

(58) Field of Classification Search

None

See application file for complete search history.

(56) References Cited

U.S. PATENT DOCUMENTS

| | | | | |
|---|---|---|---|---|
| 5,455,888 | A | 10/1995 | Iyengar et al. | |
| 5,581,652 | A | 12/1996 | Abe et al. | |
| 5,950,153 | A | 9/1999 | Ohmori et al. | |
| 5,978,759 | A | 11/1999 | Tsushima et al. | |
| 6,507,820 | B1 | 1/2003 | Deutgen | |
| 6,675,144 | B1 | 1/2004 | Tucker et al. | |
| 6,691,083 | B1 * | 2/2004 | Breen | 704/220 |
| 6,704,711 | B2 | 3/2004 | Gustafsson et al. | |
| 6,829,360 | B1 | 12/2004 | Iwata et al. | |
| 7,216,074 | B2 | 5/2007 | Malah et al. | |
| 7,346,499 | B2 | 3/2008 | Cehnnoukh et al. | |
| 7,630,881 | B2 * | 12/2009 | Iser et al. | 704/203 |
| 7,756,714 | B2 * | 7/2010 | Iser et al. | 704/500 |

(Continued)

FOREIGN PATENT DOCUMENTS

| | | |
|---|---|---|
| CN | 1416563 A | 5/2003 |
| EP | 1970900 A1 | 9/2008 |
| WO | 2006/107837 | 10/2006 |

OTHER PUBLICATIONS

Enbom et al., "Bandwidth expansion of speech based on vector quantization of the mel frequency cepstral coefficients," Speech Coding Proceedings, 1999 IEEE Workshop on , vol., no., pp. 171-173, 1999.*

(Continued)

*Primary Examiner* — Brian Albertalli

(74) *Attorney, Agent, or Firm* — Heejong Yoo

(57) ABSTRACT

A method for determining an upperband speech signal from a narrowband speech signal is disclosed. A list of narrowband line spectral frequencies (LSFs) is determined from the narrowband speech signal. A first pair of adjacent narrowband LSFs that have a lower difference between them than every other pair of adjacent narrowband LSFs in the list is determined. A first feature that is a mean of the first pair of adjacent narrowband LSFs is determined. Upperband LSFs are determined based on at least the first feature using codebook mapping.

32 Claims, 11 Drawing Sheets

U.S. PATENT DOCUMENTS

| | | | | |
|---|---|---|---|---|
| 7,783,479 | B2 * | 8/2010 | Iser et al. | 704/219 |
| 7,792,680 | B2 * | 9/2010 | Iser et al. | 704/500 |
| 8,190,429 | B2 * | 5/2012 | Iser et al. | 704/223 |
| 8,244,547 | B2 * | 8/2012 | Sudo et al. | 704/500 |
| 2004/0243402 | A1 * | 12/2004 | Ozawa | 704/208 |
| 2007/0088542 | A1 | 4/2007 | Vos et al. | |

OTHER PUBLICATIONS

Gustafsson et al., "Low-complexity feature-mapped speech bandwidth extension," Audio, Speech, and Language Processing, IEEE Transactions on , vol. 14, No. 2, pp. 577-588, Mar. 2006.*

Chennoukh et al., "Speech enhancement via frequency bandwidth extension using line spectral frequencies," Acoustics, Speech, and Signal Processing, 2001. Proceedings. (ICASSP '01). 2001 IEEE International Conference on , vol. 1, no., pp. 665-668 vol. 1, 2001.*

Epps and W H Holmes J: "Speech Enhancement Using STC-Based Bandwidth Extension", 19981001, Oct. 1, 1998, p. P711, XP007000515.

International Search Report and Written Opinion—PCT/US2010/053882, International Search Authority—European Patent Office—Jan. 28, 2011.

Hu R, et al., "Speech bandwidth extension by improved codebook mapping towards increased phonetic classification", 9TH European Conference on Speech Communication and Technology—9th European Conference on Speech Communication and Technology, Eurospeech Interspeech 2005 International Speech and Communication Association FR, pp. 1501-1504, XP002616091.

3rd Generation Partnership Project 2, "Enhanced Variable Rate Codec, Speech Service Options 3, 68, and 70 for Wideband Spread Spectrum Digital Systems," 3GPP2 C.S0014-C, Version 1.0, http://www.3gpp2.org/Public_html/specs/C.S0014-C_v1.0_070116.pdf, Oct. 19, 2010.

Unno, Takahiro; McCree, Alan., "A Robust Narrowband to Wideband Extension System Featuring Enhanced Codebook Mapping," IEEE Conference on Acoustics, Speech, and Signal Processing, vol. 1, pp. 805-808, Mar. 2005.

Kun-Youl Park, and Hyung Soon Kim, "Narrowband to Wideband Conversion of Speech Using GMM Based Transformation," IEEE International Conference on Acoustics, Speech, and Signal Processing, vol. 3, pp. 1843-1846, 2000.

Taiwan Search Report—TW099136359—TIPO—Mar. 3, 2013.

* cited by examiner

DETERMINING AN UPPERBAND SIGNAL FROM A NARROWBAND SIGNAL

RELATED APPLICATIONS

This application is related to and claims priority from U.S. Provisional Patent Application Ser. No. 61/254,623 filed Oct. 23, 2009, for "Determining an Upperband Signal from a Narrowband Signal."

TECHNICAL FIELD

The present disclosure relates generally to communication systems. More specifically, the present disclosure relates to determining an upperband signal from a narrowband signal.

BACKGROUND

Wireless communication systems have become an important means by which many people worldwide have come to communicate. A wireless communication system can provide communication for a number of wireless communication devices, each of which may be serviced by a base station. A wireless communication device is capable of using multiple protocols and operating at multiple frequencies to communicate in multiple wireless communication systems.

In order to accommodate many users, different techniques are used to maximize efficiency within a wireless communication system. For example, speech is often compressed into a narrow bandwidth for transmission. This allows more users to access a network, but also results in poor speech quality at the receiver. Therefore, benefits may be realized by improved systems and methods for determining an upperband signal from a narrowband signal.

SUMMARY

A method for determining an upperband speech signal from a narrowband speech signal is disclosed. A list of narrowband line spectral frequencies (LSFs) is determined from the narrowband speech signal. A first pair of adjacent narrowband LSFs that have a lower difference between them than every other pair of adjacent narrowband LSFs in the list is determined. A first feature that is a mean of the first pair of adjacent narrowband LSFs is determined. Upperband LSFs are determined based on at least the first feature using codebook mapping.

In one configuration, a narrowband excitation signal may be determined based on the narrowband speech signal. An upperband excitation signal may be determined based on the narrowband excitation signal. Upperband linear prediction (LP) filter coefficients may be determined based on the upperband line spectral frequencies (LSFs). The upperband excitation signal may be filtered using the upperband LP filter coefficients to produce a synthesized upperband speech signal. A gain for the synthesized upperband speech signal may be determined. The gain may be applied to the synthesized upperband speech signal.

If a current speech frame is a voiced frame, a window may be applied to the narrowband excitation signal. A narrowband energy of the narrowband excitation signal may be calculated within the window. The narrowband energy may be converted to a logarithmic domain. The logarithmic narrowband energy may be linearly mapped to a logarithmic upperband energy. The logarithmic upperband energy may be converted to a non-logarithmic domain.

If a current speech frame is an unvoiced frame, a narrowband Fourier transform of the narrowband excitation signal may be determined. Subband energies of the narrowband Fourier transform may be calculated. The subband energies may be converted to a logarithmic domain. A logarithmic upperband energy from the logarithmic subband energies may be determined based on how the subband energies relate to each other and a spectral tilt parameter calculated from narrowband linear prediction coefficients. The logarithmic upperband energy may be converted to a non-logarithmic domain. If the current speech frame is a silent frame, an upperband energy may be determined that is 20 dB below an energy of the narrowband excitation signal.

In another configuration, N unique adjacent narrowband LSF pairs may be determined such that the absolute difference between the elements of the pairs is in increasing order. N may be a predetermined number. N features that are means of the LSF pairs in the series may be determined. Upperband LSFs may be determined based on the N features using codebook mapping.

In order to determine upperband line spectral frequencies (LSFs), an entry in a narrowband codebook may be determined that most closely matches the first feature, and the narrowband codebook may be selected based on whether a current speech frame is classified as voiced, unvoiced or silent. An index of the entry in the narrowband codebook may also be mapped to an index in an upperband codebook, and the upperband codebook may be selected based on whether the current speech frame is classified as voiced, unvoiced or silent. Upperband LSFs at the index in the upperband codebook may also be extracted from the upperband codebook. The narrowband codebook may include prototype features derived from narrowband speech and the upperband codebook may include prototype upperband line spectral frequencies (LSFs). The list of narrowband line spectral frequencies (LSFs) may be sorted in ascending order.

An apparatus for determining an upperband speech signal from a narrowband speech signal where the upperband speech spans a higher range of frequencies than the narrowband speech is also disclosed. The apparatus includes a processor and memory in electronic communication with the processor. Executable instructions are stored in the memory. The instructions are executable to determine a list of narrowband line spectral frequencies (LSFs) using Linear Predictive Coding (LPC) analysis based on the narrowband speech signal. The instructions are also executable to determine a first pair of adjacent narrowband LSFs that have a lower difference between them than every other pair of adjacent narrowband LSFs in the list. The instructions are also executable to determine a first feature that is a mean of the first pair of adjacent narrowband LSFs. The instructions are also executable to determine upperband LSFs based on at least the first feature using codebook mapping.

An apparatus for determining an upperband speech signal from a narrowband speech signal where the upperband speech spans a higher range of frequencies than the narrowband speech is also disclosed. The apparatus includes means for determining a list of narrowband line spectral frequencies (LSFs) using Linear Predictive Coding (LPC) analysis based on the narrowband speech signal. The apparatus also includes means for determining a first pair of adjacent narrowband LSFs that have a lower difference between them than every other pair of adjacent narrowband LSFs in the list. The apparatus also includes means for determining a first feature that is a mean of the first pair of adjacent narrowband LSFs. The apparatus also includes means for determining upperband LSFs based on at least the first feature using codebook mapping.

A computer-program product for determining an upperband speech signal from a narrowband speech signal where the upperband speech spans a higher range of frequencies than the narrowband speech is also disclosed. The computer-program product comprises a computer-readable medium having instructions thereon. The instructions include code for determining a list of narrowband line spectral frequencies (LSFs) using Linear Predictive Coding (LPC) analysis based on the narrowband speech signal. The instructions also include code for determining a first pair of adjacent narrowband LSFs that have a lower difference between them than every other pair of adjacent narrowband LSFs in the list. The instructions also include code for determining a first feature that is a mean of the first pair of adjacent narrowband LSFs. The instructions also include code for determining upperband LSFs based on at least the first feature using codebook mapping.

DETAILED DESCRIPTION

Wideband speech (50-8000 Hz) is desirable to listen to (as opposed to narrowband speech) because it is higher quality and generally sounds better. However, in many cases, only narrowband speech is available since speech communication over traditional landline and wireless telephone systems is often limited to the narrowband frequency range of 300-4000 Hz. Wideband speech transmission and reception systems are becoming increasingly popular but will entail significant changes to the existing infrastructure that will take quite some time. In the meanwhile, blind bandwidth extension techniques are being employed that act as a post processing module on the received narrowband speech to extend its bandwidth to the wideband frequency range without requiring any side information from the encoder. Blind estimation algorithms estimate the contents of the upperband (3500-8000 Hz band) and the bass (50-300 Hz) entirely from a narrowband signal. The term "blind" refers to the fact that no side information is received from the encoder.

In other words, the most ideal wideband speech quality solution is to encode a wideband signal at a transmitter, transmit the wideband signal, and to decode the wideband signal at a receiver, i.e., the wireless communication device. Presently, however, infrastructure and mobile devices only communicate using narrowband signals. Therefore, changing an entire wireless communication system would require costly changes to existing infrastructure and mobile devices. The present systems and methods, however, operate using existing infrastructure and communication protocols. In other words, the configurations disclosed herein can be included in existing devices with only minor changes and require no changes to existing infrastructure, thus increasing speech quality at the receiver at minimal cost.

Specifically, the present systems and methods estimate the upperband spectral envelope and the temporal energy contour of the upperband signal from the narrowband signal. Furthermore, excitation estimation and upperband synthesis techniques are also used to generate the upperband signal.

Figure 1:
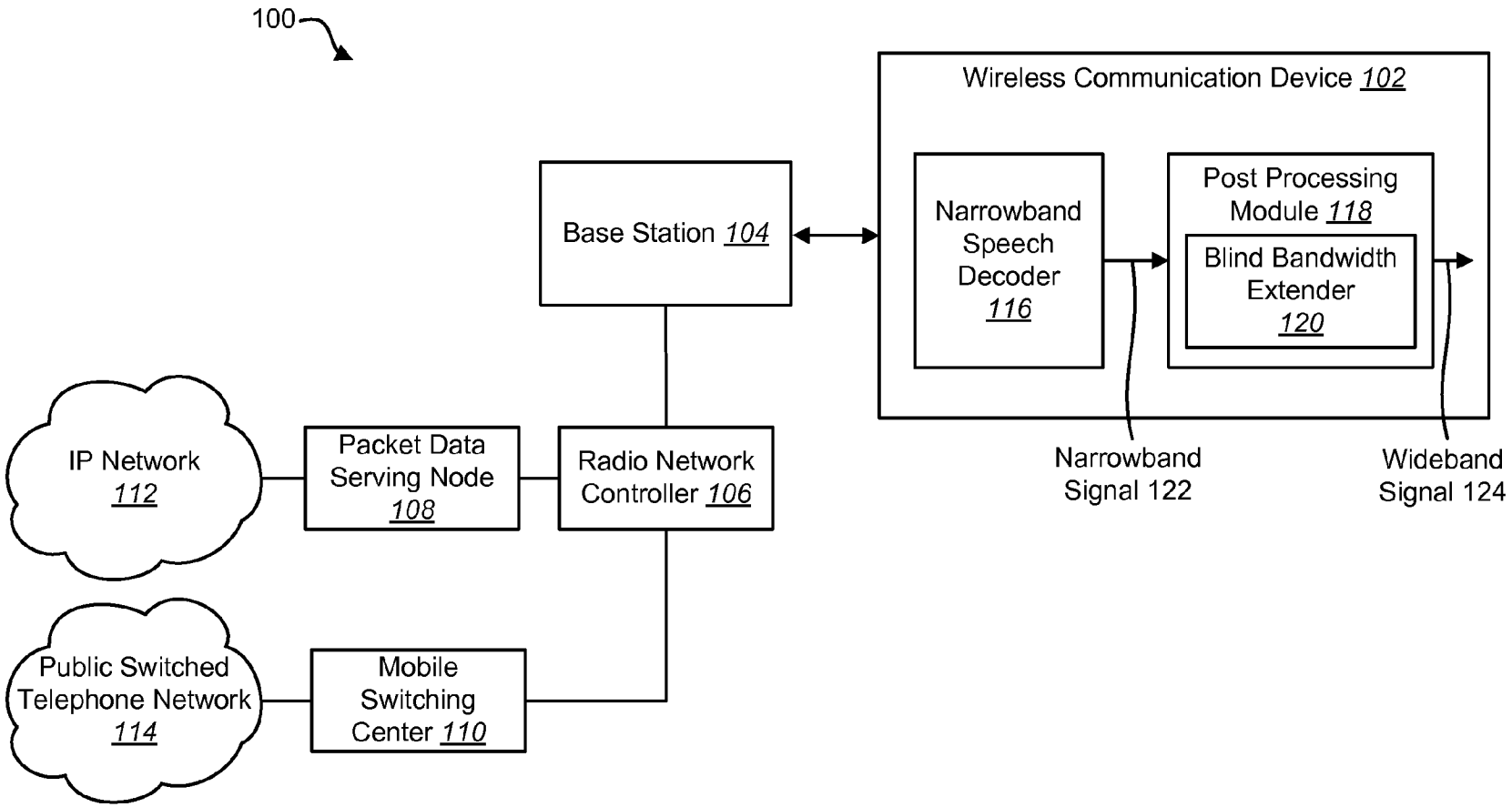
FIG. 1 is a block diagram illustrating a wireless communication system that uses blind bandwidth extension.

FIG. 1 is a block diagram illustrating a wireless communication system 100 that uses blind bandwidth extension. A wireless communication device 102 communicates with a base station 104. Examples of a wireless communication device 102 include cellular phones, personal digital assistants (PDAs), handheld devices, wireless modems, laptop computers, personal computers, etc. A wireless communication device 102 may alternatively be referred to as an access terminal, a mobile terminal, a mobile station, a remote station, a user terminal, a terminal, a subscriber unit, a mobile device, a wireless device, a subscriber station, user equipment, or some other similar terminology. The base station 104 may alternatively be referred to as an access point, a Node B, an evolved Node B, or some other similar terminology.

The base station 104 communicates with a radio network controller 106 (also referred to as a base station controller or packet control function). The radio network controller 106 communicates with a mobile switching center (MSC) 110, a packet data serving node (PDSN) 108 or internetworking function (IWF), a public switched telephone network (PSTN) 114 (typically a telephone company), and an Internet Protocol (IP) network 112 (typically the Internet). The mobile switching center 110 is responsible for managing the communication between the wireless communication device 102 and the public switched telephone network 114 while the packet data serving node 108 is responsible for routing packets between the wireless communication device 102 and the IP network 112.

The wireless communication device 102 includes a narrowband speech decoder 116 that receives a transmitted signal and produces a narrowband signal 122. Narrowband speech, however, often sounds artificial to a listener. Therefore, the narrowband signal 122 is processed by a post processing module 118. The post processing module 118 uses a blind bandwidth extender 120 to estimate an upperband signal from the narrowband signal 122 and combine the upperband signal with the narrowband signal 122 to produce a wideband signal 124. To estimate the upperband signal, the blind bandwidth extender 120 estimates an upperband spectral envelope using features from the narrowband signal 122 and estimates an upperband temporal energy (upperband gain). The wireless communication device 102 may also include other signal processing modules not shown, i.e., demodulator, de-interleaver, etc.

Figure 2:
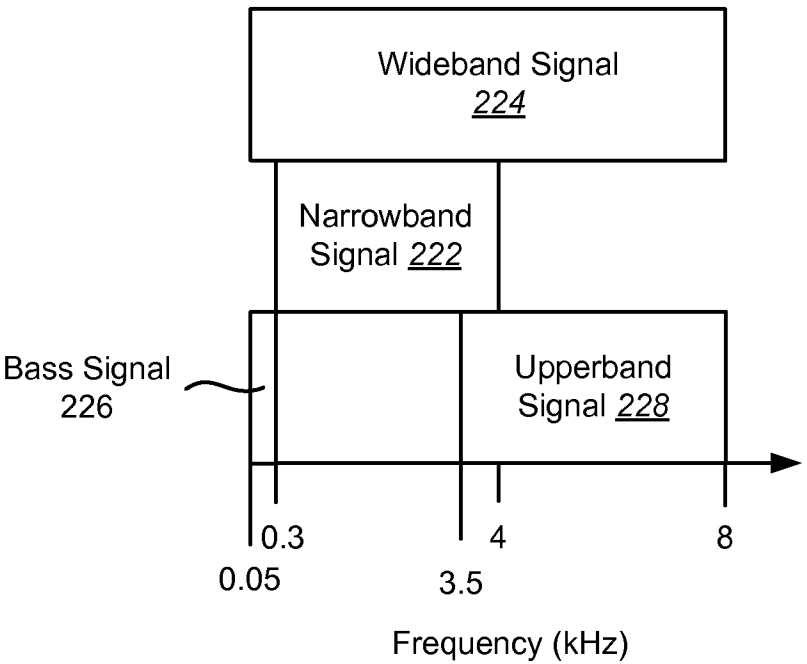
FIG. 2 is a block diagram illustrating relative bandwidths of speech signals as a function of frequency.

FIG. 2 is a block diagram illustrating relative bandwidths of speech signals as a function of frequency. As used herein, the term "wideband" refers to a signal with a frequency range of 50-8000 Hz, the term "bass" refers to a signal with a frequency range of 50-300 Hz, the term "narrowband" refers to a signal with a frequency range of 300-4000 Hz, and the term "upperband" or "highband" refers to a signal with a frequency range of 3500-8000 Hz. Therefore, the wideband signal 224 is the combination of the bass signal 226, the narrowband signal 222, and the upperband signal 228.

The illustrated upperband signal 228 and narrowband signal 222 have an appreciable overlap, such that the region of 3.5 to 4 kHz is described by both signals. Providing an overlap between the narrowband signal 222 and the upperband signal 228 allows for the use of a lowpass and/or a highpass filter having a smooth rolloff over the overlapped region. Such filters are easier to design, less computationally complex, and/or introduce less delay than filters with sharper or "brick-wall" responses. Filters having sharp transition regions tend to have higher sidelobes (which may cause aliasing) than filters of similar order that have smooth rolloffs. Filters having sharp transition regions may also have long impulse responses which may cause ringing artifacts.

In a typical wireless communication device 102, one or more of the transducers (i.e., the microphone and the earpiece or loudspeaker) may lack an appreciable response over the frequency range of 7-8 kHz. Therefore, although shown as having frequency ranges up to 8000 Hz, the upperband signal 228 and wideband signal 224 may actually have maximum frequencies of 7000 Hz or 7500 Hz.

Figure 3:
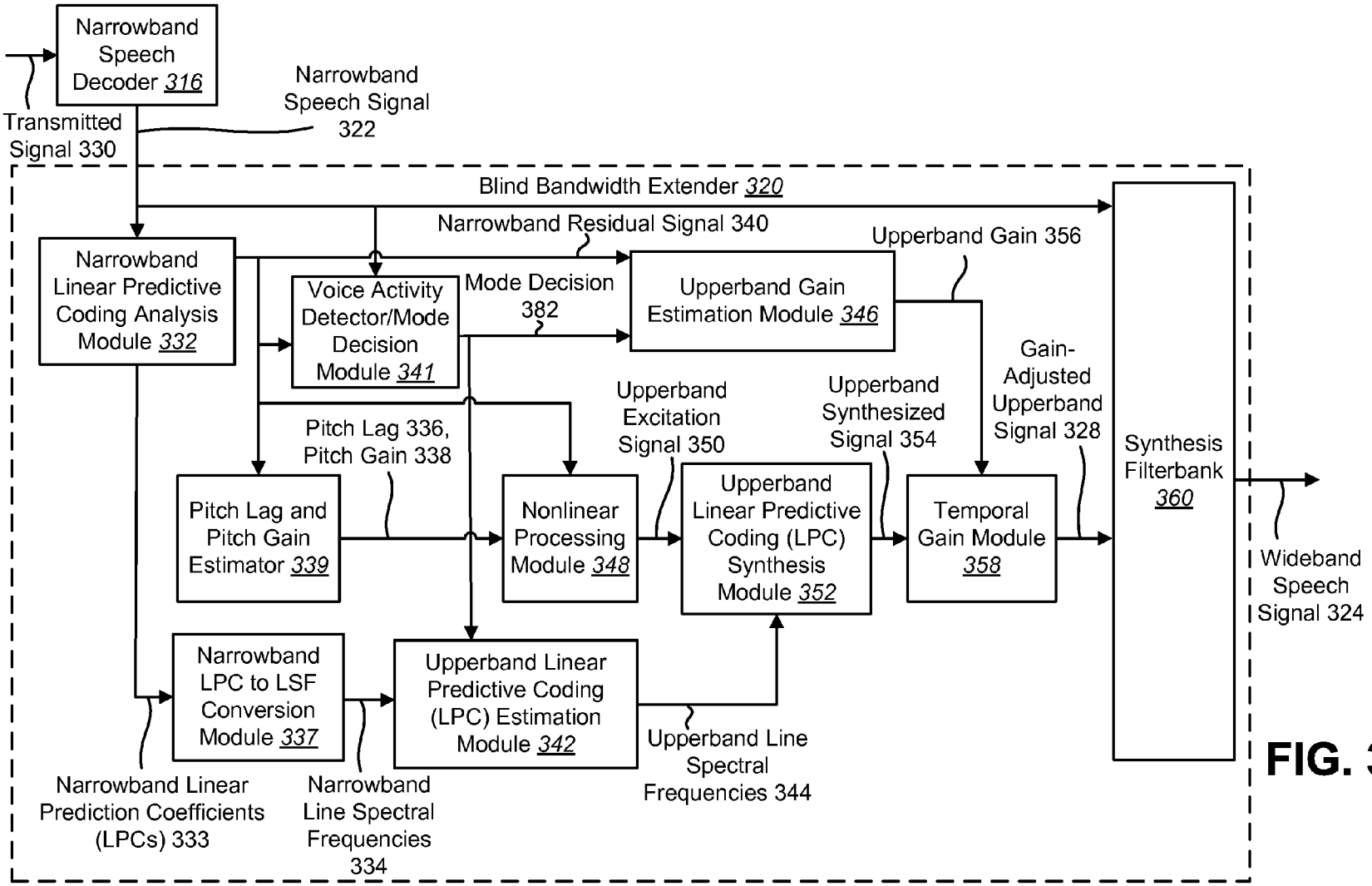
FIG. 3 is a block diagram illustrating blind bandwidth extension.

FIG. 3 is a block diagram illustrating blind bandwidth extension. A transmitted signal 330 is received and decoded by a narrowband speech decoder 316. The transmitted signal 330 may have been compressed into a narrowband frequency range for transmission across a physical channel. The narrowband speech decoder 316 produces a narrowband speech signal 322. The narrowband speech signal 322 is received as input by a blind bandwidth extender 320 that estimates the upperband speech signal 328 from the narrowband speech signal 322.

A narrowband linear predictive coding (LPC) analysis module 332 derives, or obtains, the spectral envelope of the narrowband speech signal 322 as a set of linear prediction (LP) coefficients 333, e.g., coefficients of an all-pole filter 1/A(z). The narrowband LPC analysis module 332 processes the narrowband speech signal 322 as a series of non-overlapping frames, with a new set of LP coefficients 333 being calculated for each frame. The frame period may be a period over which the narrowband signal 322 may be expected to be locally stationary, e.g., 20 milliseconds (equivalent to 160 samples at a sampling rate of 8 kHz). In one configuration, the narrowband LPC analysis module 332 calculates a set of ten LP filter coefficients 333 to characterize the format structure of each 20-millisecond frame. In an alternative configuration, the narrowband LPC analysis module 332 processes the narrowband speech signal 322 as a series of overlapping frames.

The narrowband LPC analysis module 332 may be configured to analyze the samples of each frame directly, or the samples may be weighted first according to a windowing function, e.g., a Hamming window. The analysis may also be performed over a window that is larger than the frame, such as a 30 millisecond window. This window may be symmetric (e.g. 5-20-5, such that it includes the 5 milliseconds immediately before and after the 20-millisecond frame) or asymmetric (e.g. 10-20, such that it includes the last 10 milliseconds of the preceding frame). The narrowband LPC analysis module 332 may calculate the LP filter coefficients 333 using a Levinson-Durbin recursion or the Leroux-Gueguen algorithm.

A narrowband LPC to LSF conversion module 337 transforms the set of LP filter coefficients 333 into a corresponding set of narrowband line spectral frequencies (LSFs) 334. A transform between a set of LP filter coefficients 333 and a corresponding set of LSFs 334 may be reversible or not.

In addition to producing narrowband LP coefficients 333, the narrowband LPC analysis module 332 also produces a narrowband residual signal 340. A pitch lag and pitch gain estimator 339 produces a pitch lag 336 and a pitch gain 338 from the narrowband residual signal 340. The pitch lag 336 is the delay that maximizes the autocorrelation function of the short-term prediction residual signal 340, subject to certain constraints. This calculation is carried out independently over two estimation windows. The first of these windows includes the $80^{th}$ sample to the $240^{th}$ sample of the residual signal 340; the second window includes the $160^{th}$ sample to the $320^{th}$ sample. Rules are then applied to combine the delay estimates and gains for the two estimation windows.

A voice activity detector/mode decision module 341 produces a mode decision 382 based on the narrowband speech signal 322, the narrowband residual signal 340, or both. This includes separating active speech from background noise using a rate determination algorithm (RDA) that selects one of three rates (rate 1, rate ½ or rate ⅛) for every frame of speech. Using the rate information, speech frames are classified into one of three types: voiced, unvoiced or silence (background noise). After broadly classifying the speech broadly into speech, and background noise, the voice activity detector/mode decision module 341 further classifies the current frame of speech into either voiced or unvoiced frame. Frames that are classified as rate ⅛ by the RDA are designated as silence or background noise frame. The mode decision 382 is then used by the upperband LPC estimation module 342 to choose a voiced codebook or an unvoiced codebook when estimating the upperband LSFs 344. The mode decision 382 is also used by the upperband gain estimation module 346.

The narrowband LSFs 334 are used by the upperband LPC estimation module 342 to produce upperband LSFs 344. This includes extracting one or more features from the narrowband LSFs 334, determining an appropriate narrowband codebook, and then mapping an index in the narrowband codebook to an upperband codebook to produce the upperband LSFs 344. In other words, rather than mapping the narrowband spectral envelope to the upperband spectral envelope, the upperband LPC estimation module 342 maps the spectral peaks in the narrowband speech signal 322 (indicated by the extracted features) to the upperband spectral envelope.

A nonlinear processing module 348 converts the narrowband residual signal 340 to an upperband excitation signal 350. This includes harmonically extending the narrowband residual signal 340 and combining it with a modulated noise signal. An upperband LPC synthesis module 352 uses the upperband LSFs 344 to determine upperband LP filter coefficients that are used to filter the upperband excitation signal 350 to produce an upperband synthesized signal 354.

Additionally, an upperband gain estimation module 346 produces an upperband gain 356 that is used by a temporal gain module 358 to scale up the energy of the upperband synthesized signal 354 to produce a gain-adjusted upperband signal 328, i.e., the estimate of the upperband speech signal.

An upperband gain contour is a parameter that controls the gains of the upperband signal every 4 milliseconds. This parameter vector (a set of 5 gain envelope parameters for a 20 milliseconds frame) is set to different values during the first unvoiced frame following a voiced frame and the first voiced frame following an unvoiced frame. In one configuration, the upperband gain contour is set to 0.2. The gain contour may control the relative gains between 4 msec segments (subframes) of the upperband frame. It may not affect the upperband energy, which is controlled independently by the upperband gain 356 parameter.

A synthesis filterbank 360 receives the gain-adjusted upperband signal 328 and the narrowband speech signal 322. The synthesis filterbank 360 may upsample each signal to increase the sampling rate of the signals, e.g., by zero-stuffing and/or by duplicating samples. Additionally, the synthesis filterbank 360 may lowpass filter and highpass filter the upsampled narrowband speech signal 322 and upsampled gain-adjusted upperband signal 328, respectively. The two filtered signals may then be summed to form wideband speech signal 324.

Figure 4:
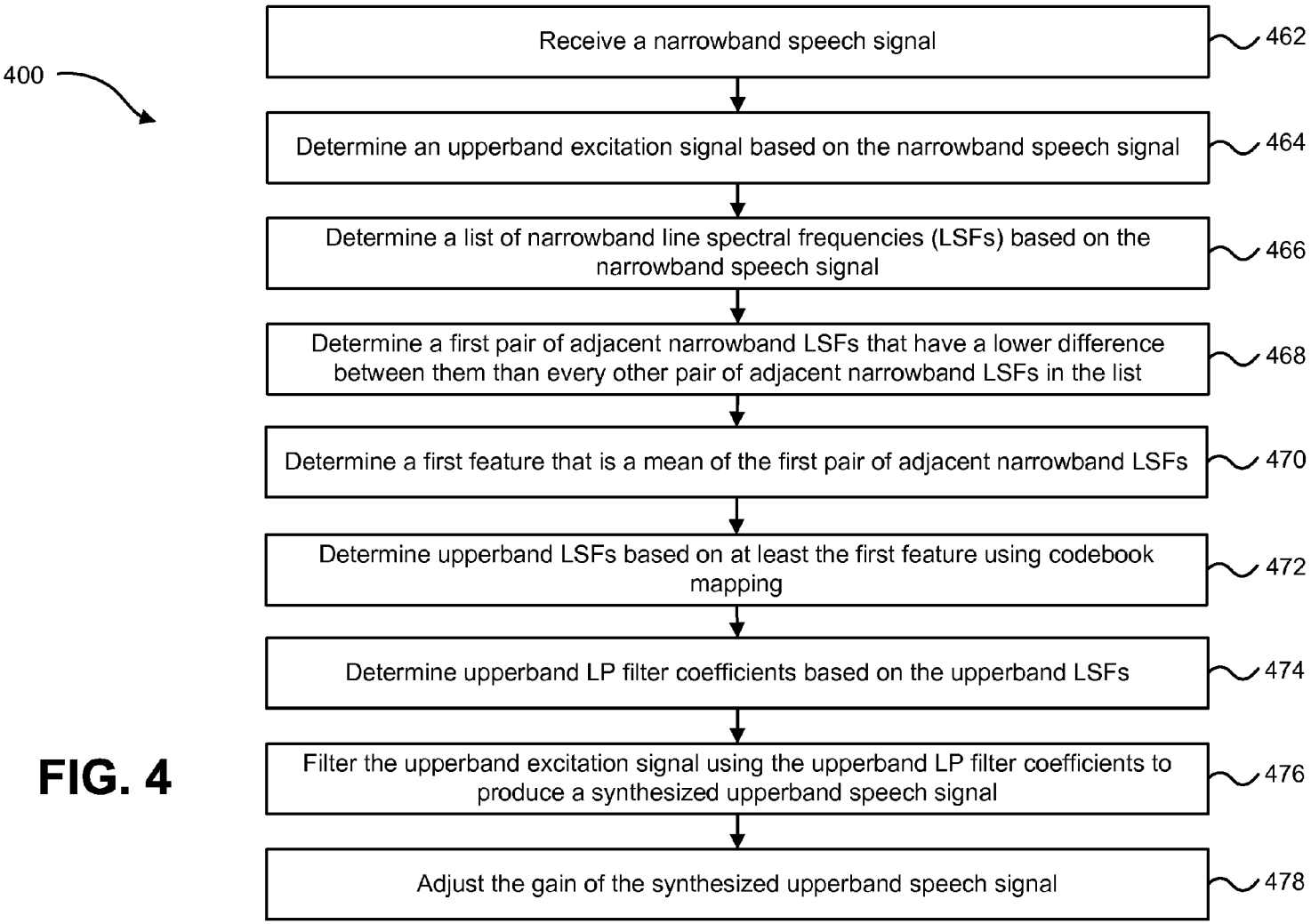
FIG. 4 is a flow diagram illustrating a method for blind bandwidth extension.

FIG. 4 is a flow diagram illustrating a method 400 for blind bandwidth extension. In other words, the method 400 estimates an upperband speech signal 328 from a narrowband speech signal 322. The method 400 is performed by a blind bandwidth extender 320. The blind bandwidth extender 320 receives 462 a narrowband speech signal 322. The narrowband speech signal 322 may have been compressed from a wideband speech signal for transmission over a physical medium. The blind bandwidth extender 320 also determines 464 an upperband excitation signal 350 based on the narrowband speech signal 322. This includes using nonlinear processing.

The blind bandwidth extender 320 also determines 466 a list of narrowband line spectral frequencies (LSFs) 334 based on the narrowband speech signal 322. This includes determining narrowband linear prediction (LP) filter coefficients from the narrowband speech signal 322 and mapping the LP filter coefficients into narrowband LSFs 334. The blind bandwidth extender 320 also determines 468 a first pair of adjacent narrowband LSFs that have a lower difference between them than every other pair of adjacent narrowband LSFs in the list. Specifically, the upperband LPC estimation module 342 finds the two adjacent narrowband LSFs 334 in the list of ten narrowband LSFs 334 (arranged in ascending order) that have the smallest difference between them. The blind bandwidth extender 320 also determines 470 a first feature that is the mean of the first pair of narrowband LSFs 334. In another configuration, the blind bandwidth extender 320 also determines second and third features that are similar to the first feature, i.e., the second feature is the mean of the next closest pair of narrowband LSFs 334 after the first pair is removed from the list, and the third feature is the mean of the next closest pair of narrowband LSFs after the first pair and second pair are removed from the list. The blind bandwidth extender 320 also determines 472 upperband LSFs 344 based on at least the first feature using codebook mapping, i.e., using the first feature (and second and third features if determined) to determine an index in a narrowband codebook and mapping the index of the narrowband codebook to an index in an upperband codebook.

The blind bandwidth extender 320 also determines 474 upperband LP filter coefficients based on the upperband LSFs 344. The blind bandwidth extender 320 also filters 476 the upperband excitation signal 350 using the upperband LP filter coefficients to produce a synthesized upperband speech signal 354. The blind bandwidth extender 320 also adjusts 478 the gain of the synthesized upperband speech signal 354 to produce a gain-adjusted upperband signal 328. This includes applying an upperband gain 356 from an upperband gain estimation module 346.

Figure 5:
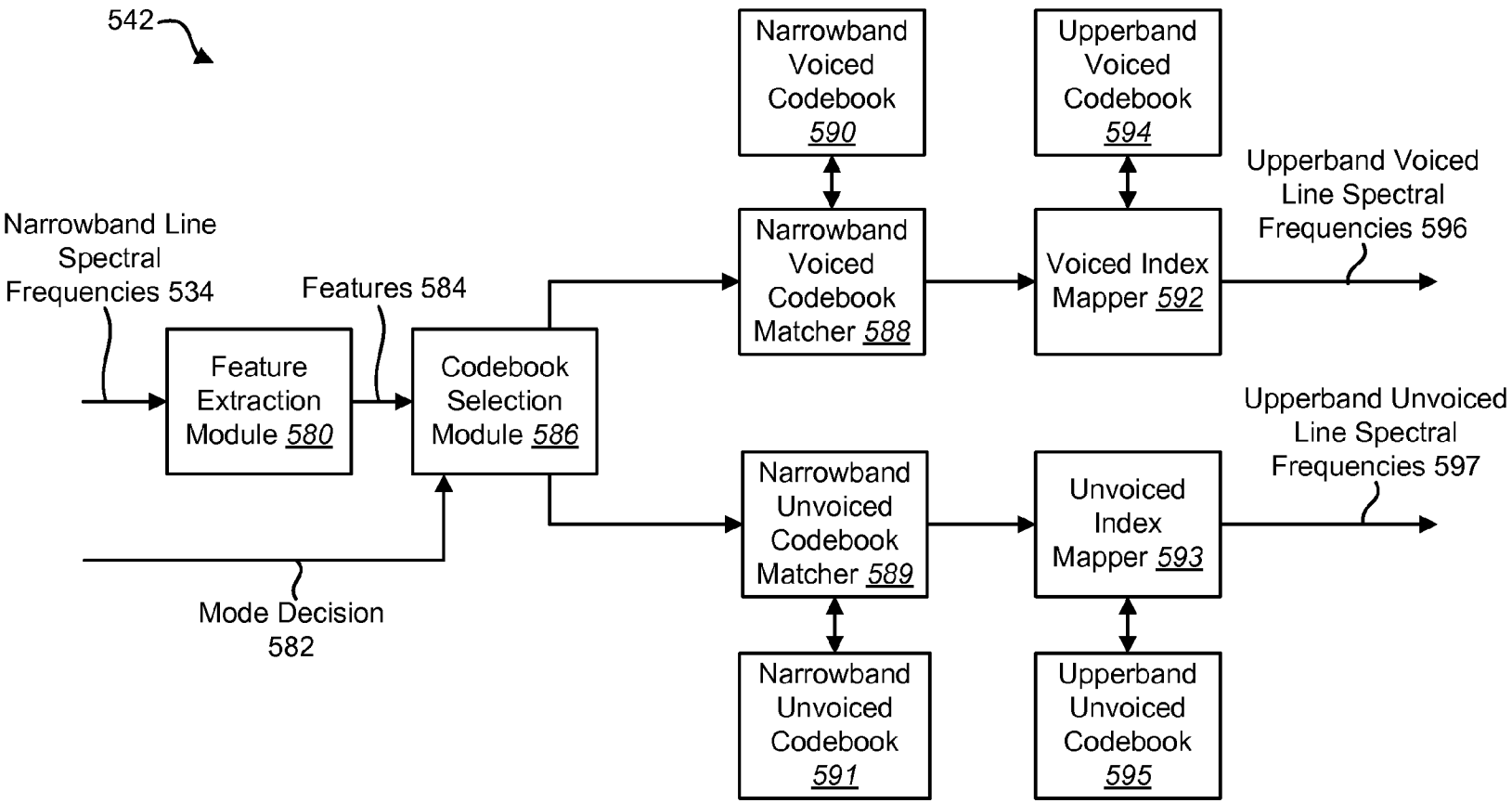
FIG. 5 is a block diagram illustrating an upperband linear predictive coding (LPC) estimation module that estimates an upperband spectral envelope.

FIG. 5 is a block diagram illustrating an upperband linear predictive coding (LPC) estimation module 542 that estimates an upperband spectral envelope. The upperband spectral envelope, as parameterized by the upperband line spectral frequencies (LSFs) 596, 597, is estimated from the narrowband LSFs 534.

The narrowband LSFs 534 are estimated from a narrowband speech signal 322 by performing linear predictive coding (LPC) analysis on the narrowband speech signal 322 and converting the linear prediction (LP) filter coefficients into the line spectral frequencies. A feature extraction module 580 estimates three feature parameters 584 from the narrowband LSFs 534. To extract the first feature 584, the distance between consecutive narrowband LSFs 534 is calculated. Then, the pair of narrowband LSFs 534 that have the least distance between them is selected and the mid point between them is selected as the first feature 584. In one configuration, more than one feature 584 is extracted. If this is the case, the selected narrowband LSF 534 pair is then be eliminated from the search for the other features 584 and the procedure is repeated with the remaining narrowband LSFs 534 to estimate the additional features 584, i.e., vectors.

A mode decision 582 may be determined based on information extracted from a received frame in the narrowband speech signal 322 that indicates whether the current frame is voiced, unvoiced, or silent. The mode decision 582 may be received by a codebook selection module 586 to determine whether to use a voiced codebook or an unvoiced codebook. The codebooks used for estimating the upperband LSFs 596, 597 for voiced and unvoiced frames may be different from each other. Alternatively, the codebooks may be chosen based on the features 584.

If the mode decision 582 indicates a voiced frame, a narrowband voiced codebook matcher 588 may project the features 584 on to a narrowband voiced codebook 590 of prototype features, i.e., the matcher 588 may find the entry in the narrowband voiced codebook 590 that best matches the features 584. A voiced index mapper 592 may map the index of the best match to an upperband voiced codebook 594. In other words, the index of the entry in the narrowband voiced codebook 590 with the best match to the features 584 may be used to look up a suitable upperband LSF 596 vector in the upperband voiced codebook 594 that includes prototype LSF vectors. The narrowband voiced codebook 590 may be trained with prototype features derived from narrowband speech while the upperband voiced codebook 594 may include prototype upperband LSF vectors, i.e., the voiced index mapper 592 may be mapping from features 584 to upperband voiced LSFs 596.

Similarly, if the mode decision 582 indicates an unvoiced frame, a narrowband unvoiced codebook matcher 589 may project the features 584 on to a narrowband unvoiced codebook 591 of prototype features, i.e., the matcher 589 may find the entry in the narrowband unvoiced codebook 591 that best matches the features 584. An unvoiced index mapper 593 may map the index of the best match to an upperband unvoiced codebook 595. In other words, the index of the entry in the narrowband unvoiced codebook 591 with the best match to the features 584 may be used to look up a suitable upperband unvoiced LSF 597 vector in the upperband unvoiced codebook 595 that includes prototype LSF vectors. The narrowband unvoiced codebook 591 may be trained with prototype features while the upperband unvoiced codebook 595 may include prototype upperband LSF vectors, i.e., the unvoiced index mapper 593 may be mapping from features 584 to upperband unvoiced LSFs 597.

Figure 6:
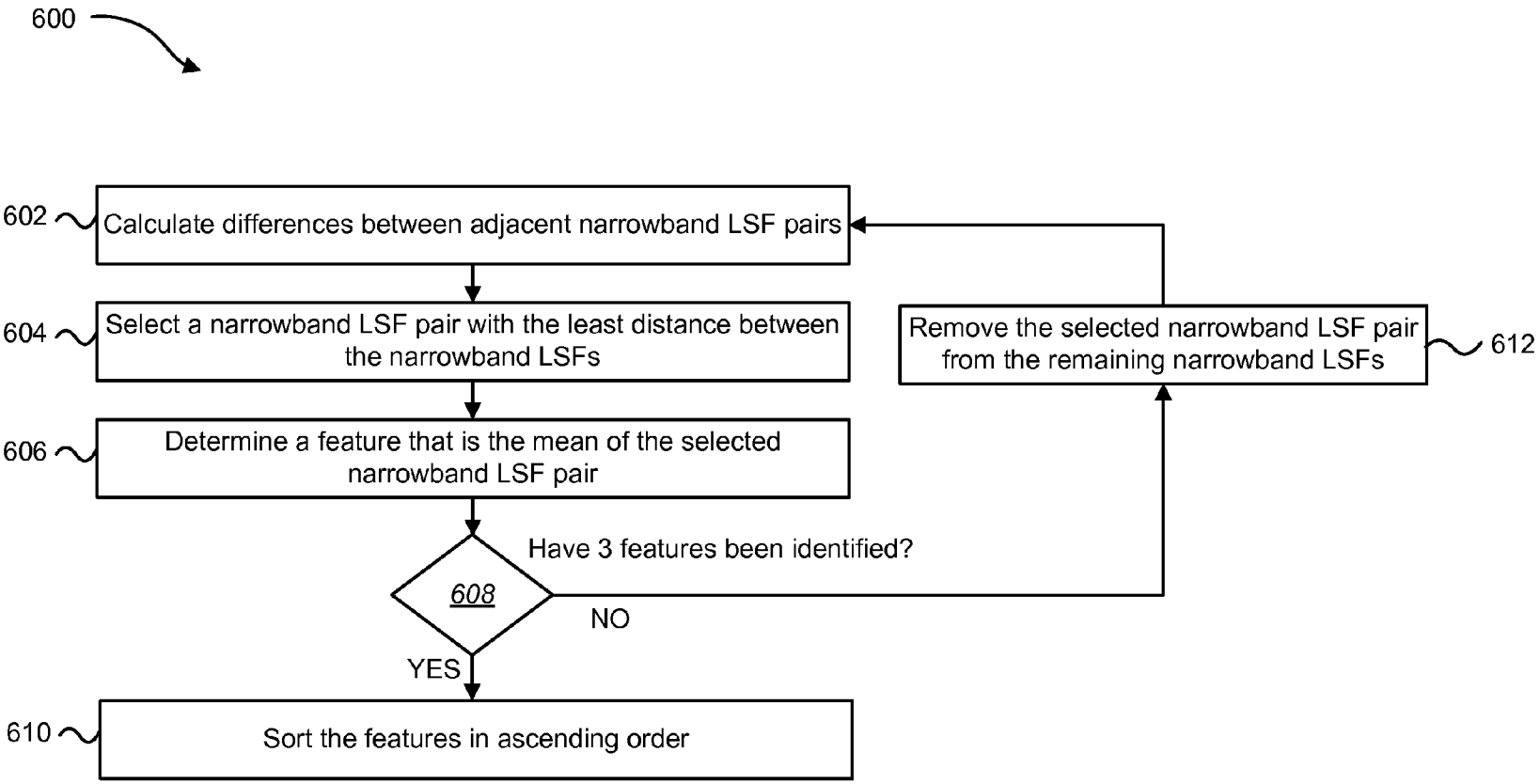
FIG. 6 is a flow diagram illustrating a method for extracting features from a list of narrowband line spectral frequencies (LSFs)

FIG. 6 is a flow diagram illustrating a method 600 for extracting features from a list of narrowband line spectral frequencies (LSFs) 534. The method 600 is performed by a feature extraction module 580. The feature extraction module 580 calculates 602 differences between adjacent narrowband LSF 534 pairs. The narrowband LSFs 534 are received from a narrowband LPC analysis module 332 as a list of ten values organized in ascending order. Therefore, there are nine differences, i.e., difference between the first and second narrowband LSF 534, second and third narrowband LSF 534, third and fourth narrowband LSF 534, etc. The feature extraction module 580 also selects 604 a narrowband LSF 534 pair with the least distance between the narrowband LSFs 534. The feature extraction module 580 also determines 606 a feature 584 that is the mean of the selected narrowband LSF 534 pair. In one configuration, three features 584 are determined. In this configuration, the feature extraction module 580 determines 608 whether three features 584 have been identified. If not, the feature extraction module 580 also removes 612 the selected narrowband LSF pair from the remaining narrowband LSFs and calculates 602 the differences again to find at least one more feature 584. If three features 584 have been identified, the feature extraction module 580 sorts 610 the features 584 in ascending order. In an alternative configuration, more or less than three features 584 are identified and the method 600 is adapted accordingly.

Figure 7:
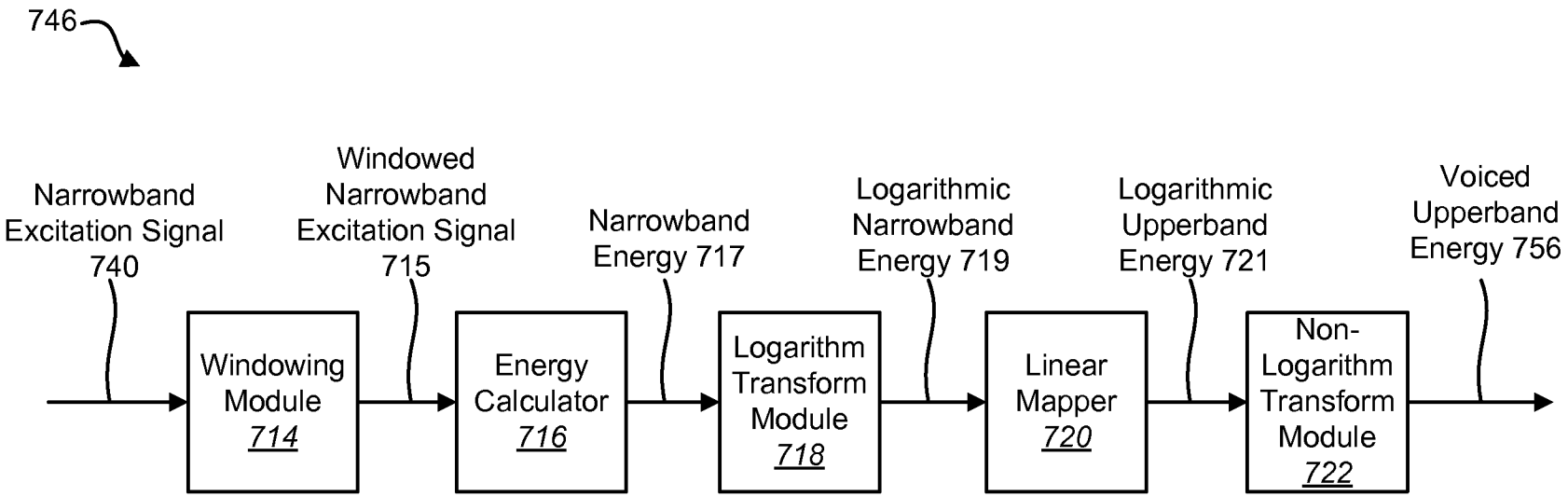
FIG. 7 is a block diagram illustrating an upperband gain estimation module.

FIG. 7 is a block diagram illustrating an upperband gain estimation module 746. The upperband gain estimation module 746 estimates the upperband energy 756 from the narrowband signal energy depending on whether a frame of speech is classified as voiced or unvoiced. FIG. 7 illustrates estimating a voiced upperband energy 756, i.e., voiced upperband gain. A linear transformation function determined using first order regression analysis on a training database is used for voiced frames.

A windowing module 714 may apply a window to a narrowband excitation signal 740. Alternatively, the upperband gain estimation module 746 may receive the narrowband speech signal 322 as input. An energy calculator 716 may calculate the energy of the windowed narrowband excitation signal 715. A logarithm transform module 718 may convert the narrowband energy 717 to the logarithmic domain, e.g., using the function $10 \log_{10}(\ )$. The logarithmic narrowband energy 719 may then be mapped to a logarithmic upperband energy 721 with a linear mapper 720. In one configuration, the linear mapping may be performed according to Equation (1):

$$g_u = \alpha g_l + \beta \tag{1}$$

where $g_u$ is the logarithmic upperband energy 721, $g_l$ is the logarithmic narrowband energy 719, $\alpha$=0.84209 and $\beta$=−5.35639. The logarithmic upperband energy 721 may then be converted to the non-logarithmic domain with a non-logarithm transform module 722 to produce a voiced upperband energy 756, e.g., using the function $10^{(g/10)}$.

The narrowband speech signal, when filtered through an LPC analysis filter at the encoder may yield the narrowband residual signal at the encoder. At the decoder, the narrowband residual signal may be reproduced as the narrowband excitation signal. At the decoder, the narrowband excitation signal is filtered through the LPC synthesis filter. The result of this filtering is the decoded synthesized narrowband speech signal.

Figure 8:
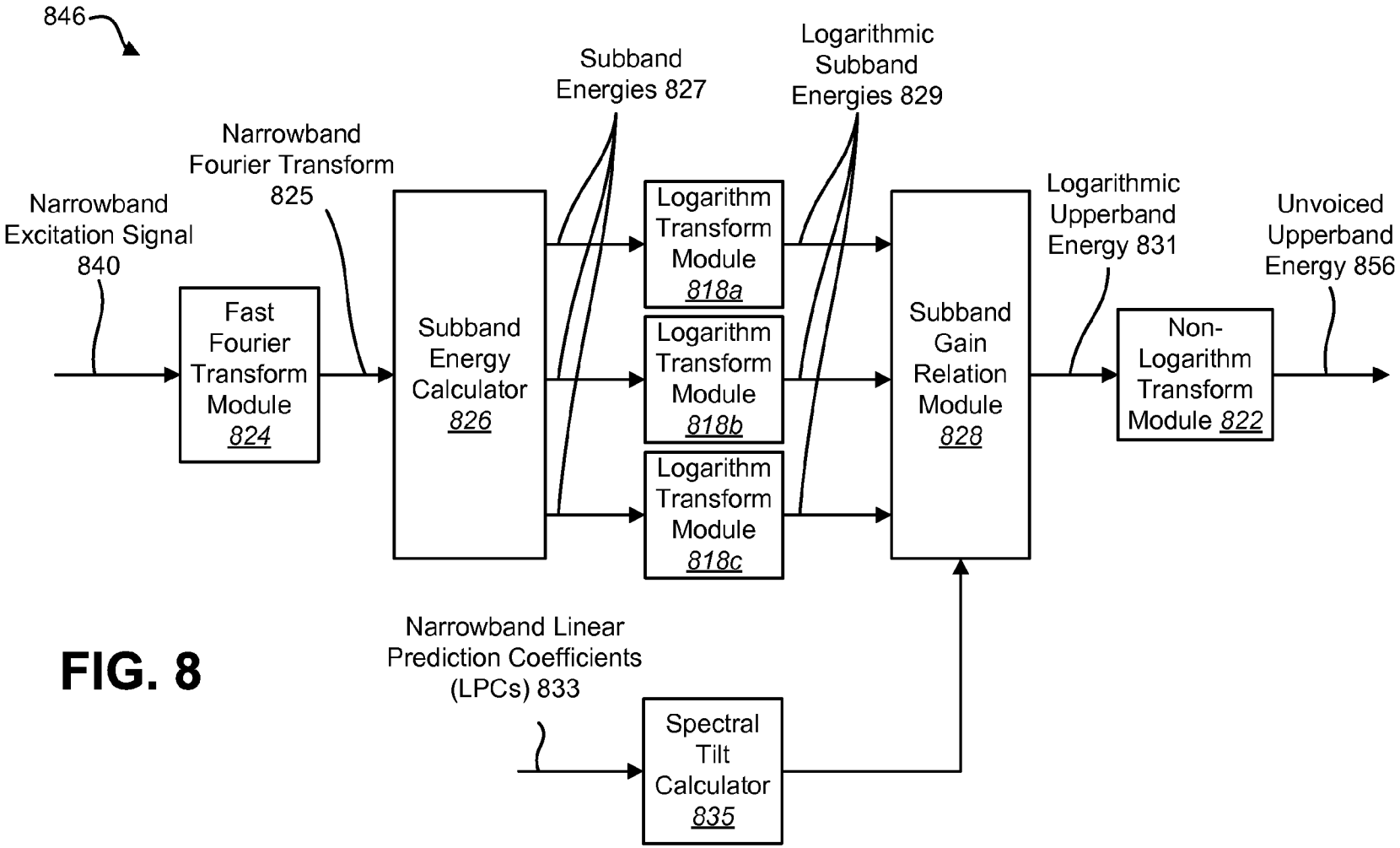
FIG. 8 is another block diagram illustrating an upperband gain estimation module.

FIG. 8 is another block diagram illustrating an upperband gain estimation module 846. Specifically, FIG. 8 illustrates estimating an unvoiced upperband energy 856, i.e., unvoiced upperband gain. For unvoiced frames, the upperband energy 856 is derived using heuristic metrics that involve the subband gains and the spectral tilt.

The Fast Fourier Transform (FFT) module 824 may compute the narrowband Fourier transform 825 of a narrowband excitation signal 840. Alternatively, the upperband gain estimation module 846 may receive the narrowband speech signal 322 as input. A subband energy calculator 826 may split the narrowband Fourier transform 825 into three different subbands and calculate the energy of each of these subbands. For example, the bands may be 280-875 Hz, 875-1780 Hz, and 1780-3600 Hz. Logarithm transform modules 818*a-c* may convert the subband energies 827 to logarithmic subband energies 829, e.g., using the function $10 \log_{10}(\ )$.

A subband gain relation module 828 may then determine the logarithmic upperband energy 831 based on how the logarithmic subband energies 829 are related, along with the spectral tilt. The spectral tilt may be determined by a spectral tilt calculator 835 based on narrowband linear prediction coefficients (LPCs) 833. In one configuration, the spectral tilt parameter is calculated by converting the narrowband LPC parameters 833 into a set of reflection coefficients and selecting the first reflection coefficient to be the spectral tilt. For example, to determine the logarithmic upperband energy 831, the subband gain relation module 828 may use the following pseudo code:

```
if (spectral_tilt>0)
    if (g3> g2 && g2> g1) {
        enhfact=(1+ 0.95 * spectral_tilt);
            if (enhfact>2) {
                enhfact=2;
            }
            gH= g3+(g3 − g2 );
            gH=enhfact*gH;
    } else {
        if (g1<0 || g2<0 || g3<0 || g3< g2)
            gH = g3 *(2.0* spectral_tilt +1);
        else
            gH = g3 *(0.9* spectral_tilt +0.8);
    }
} else {
    if (g3 > g2 && g2 > g1 ) {
        enhfact=( g3 / g2 );
        if (enhfact>2)
            enhfact=2;
        gH =enhfact* g3;
    } else {
        gH = g3;
    }
}
```

where spectral_tilt is the spectral tilt determined from the narrowband LPCs 833, $g_H$ is the logarithmic upperband energy 831, $g_1$ is the logarithmic energy of the first subband, $g_2$ is the logarithmic energy of the second subband, $g_3$ is the logarithmic energy of the third subband and enhfact is an intermediate variable used in the determination of $g_H$.

The logarithmic upperband energy 831 may then be converted to the non-logarithmic domain with a non-logarithm transform module 822 to produce an unvoiced upperband energy 856, e.g., using the function $10^{(g/10)}$. Furthermore, for silence frames, the upperband energy may be set to 20 dB below the narrowband energy.

Figure 9:
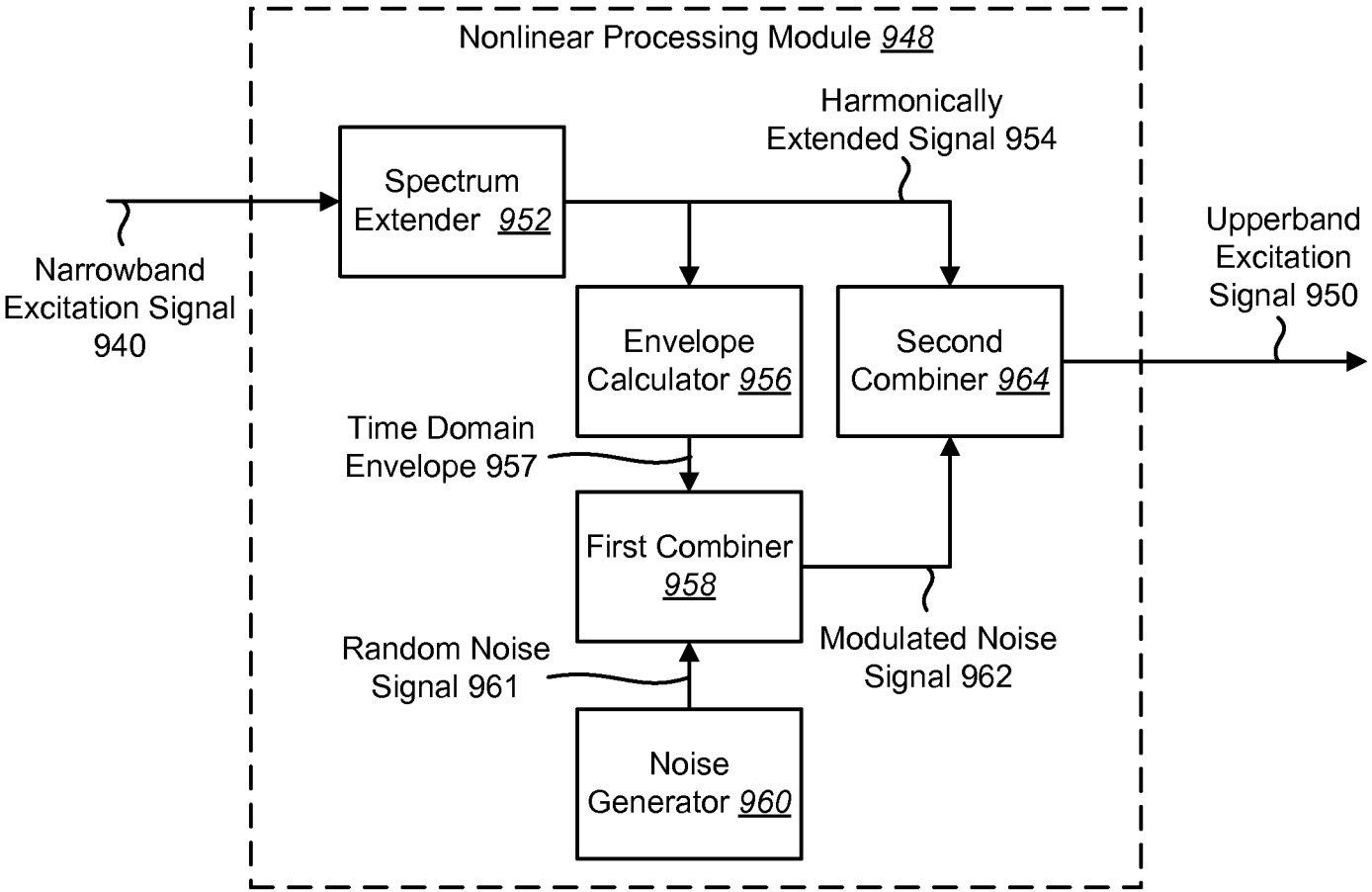
FIG. 9 is a block diagram illustrating a nonlinear processing module.

FIG. 9 is a block diagram illustrating a nonlinear processing module 948. The nonlinear processing module 948 generates an upperband excitation signal 950 by extending the spectrum of a narrowband excitation signal 940 into the upperband frequency range. A spectrum extender 952 may produce a harmonically extended signal 954 based on the narrowband excitation signal 940. A first combiner 958 may combine a random noise signal 961 generated by a noise generator 960 and a time-domain envelope 957 calculated by an envelope calculator 956 to produce a modulated noise signal 962. In one configuration, the envelope calculator 956 calculates the envelope of the harmonically extended signal 954. In an alternative configuration, the envelope calculator 856 calculates the time-domain envelope 957 of other signals, e.g., the envelope calculator 956 approximates the energy distribution over time of a narrowband speech signal 322, or the narrowband excitation signal 940. A second combiner 964 may then mix the harmonically extended signal 954 and the modulated noise signal 962 to produce an upperband excitation signal 950.

In one configuration, the spectrum extender 952 performs a spectral folding operation (also called mirroring) on the narrowband excitation signal 940 to produce the harmonically extended signal 954. Spectral folding may be performed by zero-stuffing the narrowband excitation signal 940 and then applying a highpass filter to retain the alias. In another configuration, the spectrum extender 952 produces the harmonically extended signal 954 by spectrally translating the narrowband excitation signal 940 into the upperband, e.g., via upsampling followed by multiplication with a constant-frequency cosine signal.

Spectral folding and translation methods may produce spectrally extended signals whose harmonic structure is discontinuous with the original harmonic structure of the narrowband excitation signal 940 in phase and/or frequency. For example, such methods may produce signals having peaks that are not generally located at multiples of the fundamental frequency, which may cause tinny-sounding artifacts in the reconstructed speech signal. These methods may also produce high-frequency harmonics that have unnaturally strong tonal characteristics. Moreover, because a signal from a public switched telephone network (PSTN) may be sampled at 8 kHz but band limited at around 3400 Hz, the upper spectrum of the narrowband excitation signal 940 may include little or no energy, such that an extended signal generated according to a spectral folding or spectral translation operation may have a spectral hole above 3400 Hz.

Other methods of generating harmonically extended signal 954 include identifying one or more fundamental frequencies of the narrowband excitation signal 940 and generating harmonic tones according to that information. For example, the harmonic structure of an excitation signal may be characterized by the fundamental frequency together with amplitude and phase information. In another configuration, the nonlinear processing module 948 generates a harmonically extended signal 954 based on the fundamental frequency and amplitude (as indicated, for example, by the pitch lag 336 and pitch gain 338). Unless the harmonically extended signal 954 is phase-coherent with the narrowband excitation signal 940, however, the quality of the resulting decoded speech may not be acceptable.

A nonlinear function may be used to create an upperband excitation signal 950 that is phase-coherent with the narrowband excitation signal 940 and preserves the harmonic structure without phase discontinuity. A nonlinear function may also provide an increased noise level between high-frequency harmonics, which tend to sound more natural than the tonal high-frequency harmonics produced by methods such as spectral folding and spectral translation. Typical memoryless nonlinear functions that may be applied by various implementations of spectrum extender 952 include the absolute value function (also called fullwave rectification), halfwave rectification, squaring, cubing, and clipping. The spectrum extender 952 may also be configured to apply a nonlinear function having memory.

The noise generator 960 may produce a random noise signal 961. In one configuration, noise generator 960 produces a unit-variance white pseudorandom noise signal 961, although in other configurations the noise signal 961 need not be white and may have a power density that varies with frequency. The first combiner 958 may amplitude-modulate the noise signal 961 produced by noise generator 960 according to the time-domain envelope 957 calculated by envelope calculator 956. For example, the first combiner 958 may be implemented as a multiplier arranged to scale the output of noise generator 960 according to the time-domain envelope 957 calculated by envelope calculator 956 to produce modulated noise signal 962.

Figure 10:
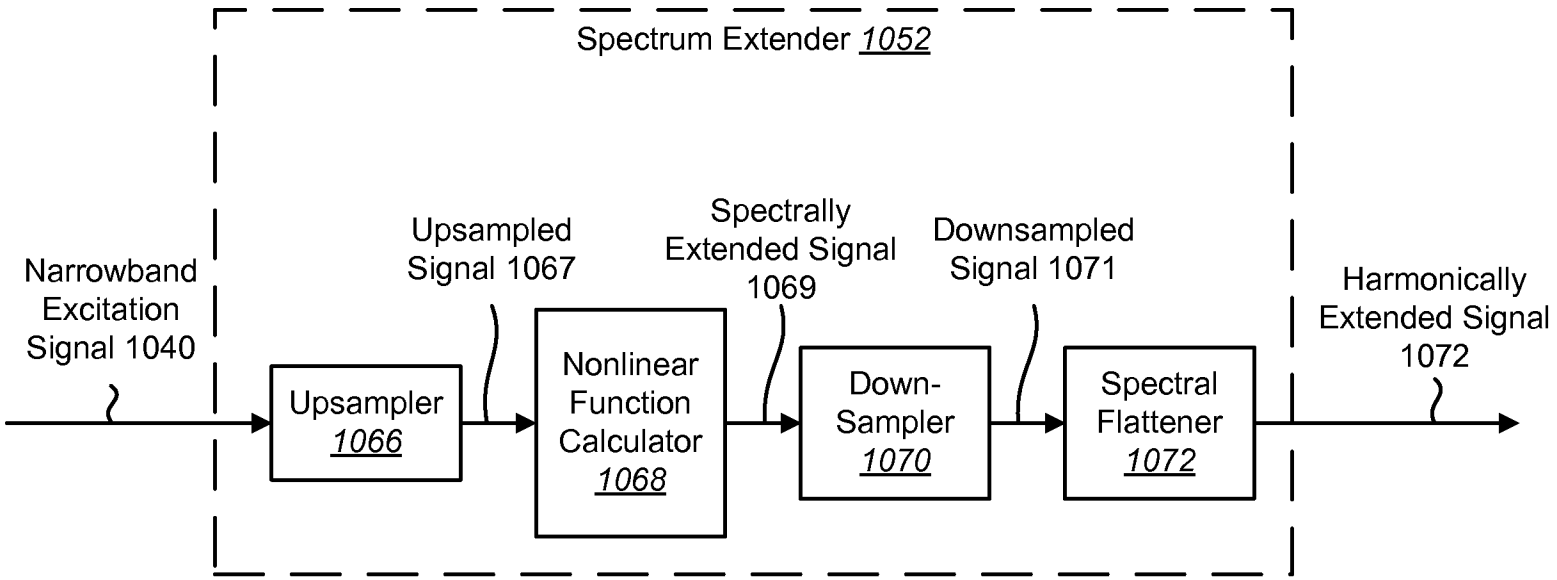
FIG. 10 is a block diagram illustrating a spectrum extender that produces a harmonically extended signal from a narrowband excitation signal.

FIG. 10 is a block diagram illustrating a spectrum extender 1052 that produces a harmonically extended signal 1072 from a narrowband excitation signal 1040. This includes applying a nonlinear function to extend the spectrum of the narrowband excitation signal 1040.

An upsampler 1066 may upsample the narrowband excitation signal 1040. It may be desirable to upsample the signal sufficiently to minimize aliasing upon application of the nonlinear function. In one particular example, the upsampler 1066 may upsample the signal by a factor of eight. The upsampler 1066 may perform the upsampling operation by zero-stuffing the input signal and lowpass filtering the result. A nonlinear function calculator 1068 may apply a nonlinear function to the upsampled signal 1067. One potential advantage of the absolute value function over other nonlinear functions for spectral extension, such as squaring, is that energy normalization is not needed. In some implementations, the absolute value function may be applied efficiently by stripping or clearing the sign bit of each sample. The nonlinear function calculator 1068 may also perform an amplitude warping of the upsampled signal 1067 or the spectrally extended signal 1069.

A downsampler 1070 may downsample the spectrally extended signal 1069 output from the nonlinear function calculator 1068 to produce a downsampled signal 1071. The downsampler 1070 may also perform bandpass filtering to select a desired frequency band of the spectrally extended signal 1069 before reducing the sampling rate (for example, to reduce or avoid aliasing or corruption by an unwanted image). It may also be desirable for the downsampler 1070 to reduce the sampling rate in more than one stage.

The spectrally extended signal 1069 produced by the nonlinear function calculator 1068 may have a pronounced drop-off in amplitude as frequency increases. Therefore, the spectral extender 1052 may include a spectral flattener 1072 to whiten the downsampled signal 1071. The spectral flattener 1072 may perform a fixed whitening operation or perform an adaptive whitening operation. In a configuration that uses adaptive whitening, the spectral flattener 1072 includes an LPC analysis module configured to calculate a set of four LP filter coefficients from the downsampled signal 1071 and a fourth-order analysis filter configured to whiten the downsampled signal 1071 according to those coefficients. Alternatively, the spectral flattener 1072 may operate on the spectrally extended signal 1069 before the downsampler 1070.

Figure 11:
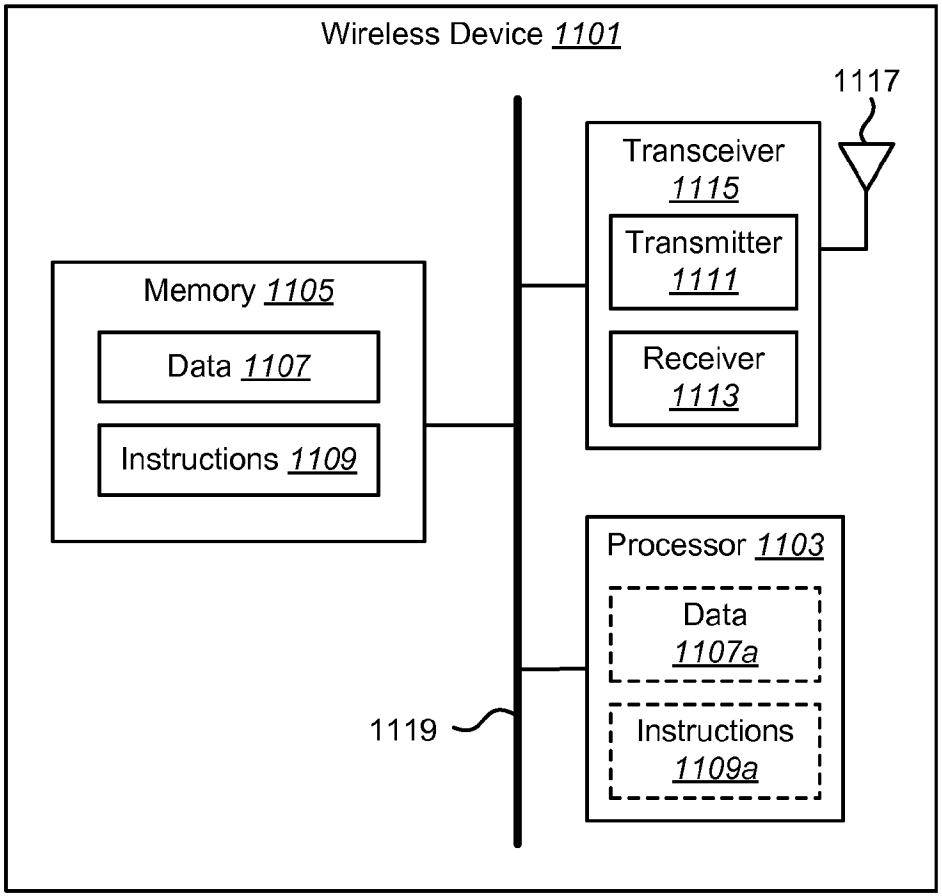
FIG. 11 illustrates certain components that may be included within a wireless device.

FIG. 11 illustrates certain components that may be included within a wireless device 1101. The wireless device 1101 may be a wireless communication device 102 or a base station 104.

The wireless device 1101 includes a processor 1103. The processor 1103 may be a general purpose single- or multi-chip microprocessor (e.g., an ARM), a special purpose microprocessor (e.g., a digital signal processor (DSP)), a microcontroller, a programmable gate array, etc. The processor 1103 may be referred to as a central processing unit (CPU). Although just a single processor 1103 is shown in the wireless device 1101 of FIG. 11, in an alternative configuration, a combination of processors (e.g., an ARM and DSP) could be used.

The wireless device 1101 also includes memory 1105. The memory 1105 may be any electronic component capable of storing electronic information. The memory 1105 may be embodied as random access memory (RAM), read only memory (ROM), magnetic disk storage media, optical storage media, flash memory devices in RAM, on-board memory included with the processor, EPROM memory, EEPROM memory, registers, and so forth, including combinations thereof.

Data 1107 and instructions 1109 may be stored in the memory 1105. The instructions 1109 may be executable by the processor 1103 to implement the methods disclosed herein. Executing the instructions 1109 may involve the use of the data 1107 that is stored in the memory 1105. When the processor 1103 executes the instructions 1109, various portions of the instructions 1109*a* may be loaded onto the processor 1103, and various pieces of data 1107*a* may be loaded onto the processor 1103.

The wireless device 1101 may also include a transmitter 1111 and a receiver 1113 to allow transmission and reception of signals between the wireless device 1101 and a remote location. The transmitter 1111 and receiver 1113 may be collectively referred to as a transceiver 1115. An antenna 1117 may be electrically coupled to the transceiver 1115. The wireless device 1101 may also include (not shown) multiple transmitters, multiple receivers, multiple transceivers and/or multiple antenna.

The various components of the wireless device 1101 may be coupled together by one or more buses, which may include a power bus, a control signal bus, a status signal bus, a data bus, etc. For the sake of clarity, the various buses are illustrated in FIG. 11 as a bus system 1119.

The techniques described herein may be used for various communication systems, including communication systems that are based on an orthogonal multiplexing scheme. Examples of such communication systems include Orthogonal Frequency Division Multiple Access (OFDMA) systems, Single-Carrier Frequency Division Multiple Access (SC-FDMA) systems, and so forth. An OFDMA system utilizes orthogonal frequency division multiplexing (OFDM), which is a modulation technique that partitions the overall system bandwidth into multiple orthogonal sub-carriers. These sub-carriers may also be called tones, bins, etc. With OFDM, each sub-carrier may be independently modulated with data. An SC-FDMA system may utilize interleaved FDMA (IFDMA) to transmit on sub-carriers that are distributed across the system bandwidth, localized FDMA (LFDMA) to transmit on a block of adjacent sub-carriers, or enhanced FDMA (EFDMA) to transmit on multiple blocks of adjacent sub-carriers. In general, modulation symbols are sent in the frequency domain with OFDM and in the time domain with SC-FDMA.

In the above description, reference numbers have sometimes been used in connection with various terms. Where a term is used in connection with a reference number, this is meant to refer to a specific element that is shown in one or more of the Figures. Where a term is used without a reference number, this is meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The term "processor" should be interpreted broadly to encompass a general purpose processor, a central processing unit (CPU), a microprocessor, a digital signal processor (DSP), a controller, a microcontroller, a state machine, and so forth. Under some circumstances, a "processor" may refer to an application specific integrated circuit (ASIC), a programmable logic device (PLD), a field programmable gate array (FPGA), etc. The term "processor" may refer to a combination of processing devices, e.g., a combination of a DSP and a microprocessor, a plurality of microprocessors, one or more microprocessors in conjunction with a DSP core, or any other such configuration.

The term "memory" should be interpreted broadly to encompass any electronic component capable of storing electronic information. The term memory may refer to various types of processor-readable media such as random access memory (RAM), read-only memory (ROM), non-volatile random access memory (NVRAM), programmable read-only memory (PROM), erasable programmable read only memory (EPROM), electrically erasable PROM (EEPROM), flash memory, magnetic or optical data storage, registers, etc. Memory is said to be in electronic communication with a processor if the processor can read information from and/or write information to the memory. Memory that is integral to a processor is in electronic communication with the processor.

The terms "instructions" and "code" should be interpreted broadly to include any type of computer-readable statement(s). For example, the terms "instructions" and "code" may refer to one or more programs, routines, sub-routines, functions, procedures, etc. "Instructions" and "code" may comprise a single computer-readable statement or many computer-readable statements.

The functions described herein may be implemented in hardware, software, firmware, or any combination thereof. If implemented in software, the functions may be stored as one or more instructions on a computer-readable medium. The term "computer-readable medium" refers to any available medium that can be accessed by a computer. By way of example, and not limitation, a computer-readable medium may comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

Further, it should be appreciated that modules and/or other appropriate means for performing the methods and techniques described herein, such as those illustrated by FIGS. 4 and 6, can be downloaded and/or otherwise obtained by a device. For example, a device may be coupled to a server to facilitate the transfer of means for performing the methods described herein. Alternatively, various methods described herein can be provided via a storage means (e.g., random access memory (RAM), read only memory (ROM), a physical storage medium such as a compact disc (CD) or floppy disk, etc.), such that a device may obtain the various methods upon coupling or providing the storage means to the device. Moreover, any other suitable technique for providing the methods and techniques described herein to a device can be utilized.

It is to be understood that the claims are not limited to the precise configuration and components illustrated above. Various modifications, changes and variations may be made in the arrangement, operation and details of the systems, methods, and apparatus described herein without departing from the scope of the claims.

The invention claimed is:

1. A method for determining an upperband speech signal from a narrowband speech signal where the upperband speech spans a higher range of frequencies than the narrowband speech, comprising:

determining a list of narrowband line spectral frequencies (LSFs) using Linear Predictive Coding (LPC) analysis based on the narrowband speech signal;

determining a first pair of adjacent narrowband LSFs that have a lower difference between them than every other pair of adjacent narrowband LSFs in the list;

determining a first feature that is a mean of the first pair of adjacent narrowband LSFs; and determining upperband LSFs based on at least the first feature using codebook mapping.

2. The method of claim 1, further comprising:

determining a narrowband excitation signal based on the narrowband speech signal; and determining an upperband excitation signal based on the narrowband excitation signal.

3. The method of claim 2, further comprising:

determining upperband linear prediction (LP) filter coefficients based on the upperband line spectral frequencies (LSFs);

filtering the upperband excitation signal using the upperband LP filter coefficients to produce a synthesized upperband speech signal;

determining a gain for the synthesized upperband speech signal; and applying the gain to the synthesized upperband speech signal.

4. The method of claim 3, wherein the determining the gain comprises:

if a current speech frame is a voiced frame:

applying a window to the narrowband excitation signal;

calculating a narrowband energy of the narrowband excitation signal within the window;

converting the narrowband energy to a logarithmic domain;

linearly mapping the logarithmic narrowband energy to a logarithmic upperband energy; and converting the logarithmic upperband energy to a non-logarithmic domain.

5. The method of claim 3, wherein the determining the gain further comprises:

if the current speech frame is an unvoiced frame:

determining a narrowband Fourier transform of the narrowband excitation signal;

calculating subband energies of the narrowband Fourier transform;

converting the subband energies to a logarithmic domain;

determining a logarithmic upperband energy from the logarithmic subband energies based on how the subband energies relate to each other and a spectral tilt parameter calculated from narrowband linear prediction coefficients; and converting the logarithmic upperband energy to a non-logarithmic domain.

6. The method of claim 3, wherein the determining the gain further comprises:

if the current speech frame is a silent frame:

determining an upperband energy that is 20 dB below an energy of the narrowband excitation signal.

7. The method of claim 1, further comprising:

determining N unique adjacent narrowband LSF pairs such that the absolute difference between elements of the pairs is in increasing order, where N is a predetermined number;

determining N features that are means of the LSF pairs in the series; and determining upperband LSFs based on the N features using codebook mapping.

8. The method of claim 1, wherein the determining upperband line spectral frequencies (LSFs) comprises:

determining an entry in a narrowband codebook that most closely matches the first feature, wherein the narrowband codebook is selected based on whether a current speech frame is classified as voiced, unvoiced or silent;

mapping an index of the entry in the narrowband codebook to an index in an upperband codebook, wherein the upperband codebook is selected based on whether the current speech frame is classified as voiced, unvoiced or silent; and extracting upperband LSFs at the index in the upperband codebook from the upperband codebook.

9. The method of claim 8, wherein the narrowband codebook comprises prototype features derived from narrowband speech and the upperband codebook comprises prototype upperband line spectral frequencies (LSFs).

10. The method of claim 1, further comprising sorting the list of narrowband line spectral frequencies (LSFs) in ascending order.

11. An apparatus for determining an upperband speech signal from a narrowband speech signal where the upperband speech spans a higher range of frequencies than the narrowband speech, comprising:

a processor;

memory in electronic communication with the processor;

instructions stored in the memory, the instructions being executable by the processor to:

determine a list of narrowband line spectral frequencies (LSFs) using Linear Predictive Coding (LPC) analysis based on the narrowband speech signal;

determine a first pair of adjacent narrowband LSFs that have a lower difference between them than every other pair of adjacent narrowband LSFs in the list;

determine a first feature that is a mean of the first pair of adjacent narrowband LSFs; and determine upperband LSFs based on at least the first feature using codebook mapping.

12. The apparatus of claim 11, further comprising instructions executable to:

determine a narrowband excitation signal based on the narrowband speech signal; and determine an upperband excitation signal based on the narrowband excitation signal.

13. The apparatus of claim 12, further comprising instructions executable to:

determine upperband linear prediction (LP) filter coefficients based on the upperband line spectral frequencies (LSFs);

filter the upperband excitation signal using the upperband LP filter coefficients to produce a synthesized upperband speech signal;

determine a gain for the synthesized upperband speech signal; and apply the gain to the synthesized upperband speech signal.

14. The apparatus of claim 13, wherein the instructions executable to determine the gain comprise instructions executable to:

if a current speech frame is a voiced frame:

apply a window to the narrowband excitation signal;

calculate a narrowband energy of the narrowband excitation signal within the window;

convert the narrowband energy to a logarithmic domain;

linearly map the logarithmic narrowband energy to a logarithmic upperband energy; and convert the logarithmic upperband energy to a non-logarithmic domain.

15. The apparatus of claim 13, wherein the instructions executable to determine the gain further comprise instructions executable to:

if the current speech frame is an unvoiced frame:

determine a narrowband Fourier transform of the narrowband excitation signal;

calculate subband energies of the narrowband Fourier transform;

convert the subband energies to a logarithmic domain;

determine a logarithmic upperband energy from the logarithmic subband energies based on how the subband energies relate to each other and a spectral tilt parameter calculated from narrowband linear prediction coefficients; and convert the logarithmic upperband energy to a non-logarithmic domain.

16. The apparatus of claim 13, wherein the instructions executable to determine the gain further comprise instructions executable to:

if the current speech frame is a silent frame:

determine an upperband energy that is 20 dB below an energy of the narrowband excitation signal.

17. The apparatus of claim 11, further comprising instructions executable to:

determine N unique adjacent narrowband LSF pairs such that the absolute difference between elements of the pairs is in increasing order, where N is a predetermined number;

determine N features that are means of the LSF pairs in the series; and determine upperband LSFs based on the N features using codebook mapping.

18. The apparatus of claim 11, wherein the instructions executable to determine upperband line spectral frequencies (LSFs) comprise instructions executable to:

determine an entry in a narrowband codebook that most closely matches the first feature wherein the narrowband codebook is selected based on whether a current speech frame is classified as voiced, unvoiced or silent;

map an index of the entry in the narrowband codebook to an index in an upperband codebook wherein the upperband codebook is selected based on whether a current speech frame is classified as voiced, unvoiced or silent; and extract upperband LSFs at the index in the upperband codebook from the upperband codebook.

19. The apparatus of claim 18, wherein the narrowband codebook comprises prototype features derived from narrowband speech and the upperband codebook comprises prototype upperband line spectral frequencies (LSFs).

20. The apparatus of claim 11, further comprising instructions executable to sort the list of narrowband line spectral frequencies (LSFs) in ascending order.

21. An apparatus for determining an upperband speech signal from a narrowband speech signal where the upperband speech spans a higher range of frequencies than the narrowband speech, comprising:

a processor;

means for determining a list of narrowband line spectral frequencies (LSFs) using Linear Predictive Coding (LPC) analysis based on the narrowband speech signal;

means for determining a first pair of adjacent narrowband LSFs that have a lower difference between them than every other pair of adjacent narrowband LSFs in the list;

means for determining a first feature that is a mean of the first pair of adjacent narrowband LSFs; and means for determining upperband LSFs based on at least the first feature using codebook mapping.

22. The apparatus of claim 21, further comprising:

means for determining a narrowband excitation signal based on the narrowband speech signal; and means for determining an upperband excitation signal based on the narrowband excitation signal.

23. The apparatus of claim 22, further comprising:

means for determining upperband linear prediction (LP) filter coefficients based on the upperband line spectral frequencies (LSFs);

means for filtering the upperband excitation signal using the upperband LP filter coefficients to produce a synthesized upperband speech signal;

means for determining a gain for the synthesized upperband speech signal; and means for applying the gain to the synthesized upperband speech signal.

24. The apparatus of claim 23, wherein the means for determining the gain comprise:

if a current speech frame is a voiced frame:

means for applying a window to the narrowband excitation signal;

means for calculating a narrowband energy of the narrowband excitation signal within the window;

means for converting the narrowband energy to a logarithmic domain;

means for linearly mapping the logarithmic narrowband energy to a logarithmic upperband energy; and means for converting the logarithmic upperband energy to a non-logarithmic domain.

25. The apparatus of claim 23, wherein the means for determining the gain further comprise:

if the current speech frame is an unvoiced frame:

means for determining a narrowband Fourier transform of the narrowband excitation signal;

means for calculating subband energies of the narrowband Fourier transform;

means for converting the subband energies to a logarithmic domain;

means for determining a logarithmic upperband energy from the logarithmic subband energies based on how the subband energies relate to each other and a spectral tilt parameter calculated from narrowband linear prediction coefficients; and means for converting the logarithmic upperband energy to a non-logarithmic domain.

26. The apparatus of claim 23, wherein the means for determining the gain further comprise:

if the current speech frame is a silent frame:

means for determining an upperband energy that is 20 dB below an energy of the narrowband excitation signal.

27. A computer-program product for determining an upperband speech signal from a narrowband speech signal where the upperband speech spans a higher range of frequencies than the narrowband speech, the computer-program product comprising a non-transitory computer-readable medium having instructions thereon, the instructions comprising:

code for determining a list of narrowband line spectral frequencies (LSFs) using Linear Predictive Coding (LPC) analysis based on the narrowband speech signal;

code for determining a first pair of adjacent narrowband LSFs that have a lower difference between them than every other pair of adjacent narrowband LSFs in the list;

code for determining a first feature that is a mean of the first pair of adjacent narrowband LSFs; and code for determining upperband LSFs based on at least the first feature using codebook mapping.

28. The computer-program product of claim 27, further comprising:

code for determining a narrowband excitation signal based on the narrowband speech signal; and code for determining an upperband excitation signal based on the narrowband excitation signal.

29. The computer-program product of claim 28, further comprising:

code for determining upperband linear prediction (LP) filter coefficients based on the upperband line spectral frequencies (LSFs);

code for filtering the upperband excitation signal using the upperband LP filter coefficients to produce a synthesized upperband speech signal;

code for determining a gain for the synthesized upperband speech signal; and code for applying the gain to the synthesized upperband speech signal.

30. The computer-program product of claim 29, wherein the code for determining the gain comprises:

if a current speech frame is a voiced frame:

code for applying a window to the narrowband excitation signal;

code for calculating a narrowband energy of the narrowband excitation signal within the window;

code for converting the narrowband energy to a logarithmic domain;

code for linearly mapping the logarithmic narrowband energy to a logarithmic upperband energy; and code for converting the logarithmic upperband energy to a non-logarithmic domain.

31. The computer-program product of claim 29, wherein the code for determining the gain further comprises:

if the current speech frame is an unvoiced frame:

code for determining a narrowband Fourier transform of the narrowband excitation signal;

code for calculating subband energies of the narrowband Fourier transform;

code for converting the subband energies to a logarithmic domain;

code for determining a logarithmic upperband energy from the logarithmic subband energies based on how the subband energies relate to each other and a spectral tilt parameter calculated from narrowband linear prediction coefficients; and code for converting the logarithmic upperband energy to a non-logarithmic domain.

32. The computer-program product of claim 29, wherein the code for determining the gain further comprises:

if the current speech frame is a silent frame: code for determining an upperband energy that is 20 dB below an energy of the narrowband excitation signal.

* * * * *